US008163113B2

(12) United States Patent
Mishra et al.

(10) Patent No.: US 8,163,113 B2
(45) Date of Patent: Apr. 24, 2012

(54) THERMOMECHANICAL PROCESSING OF ALUMINUM ALLOYS

(75) Inventors: Raja K. Mishra, Shelby Township, MI (US); Anil K. Sachdev, Rochester Hills, MI (US); Shigeo Saimoto, Kingston (CA)

(73) Assignees: GM Global Technology Operations LLC, Detroit, MI (US); Queen's University at Kingston, Kingston (CA)

( * ) Notice: Subject to any disclaimer, the term of this patent is extended or adjusted under 35 U.S.C. 154(b) by 130 days.

(21) Appl. No.: 12/414,992

(22) Filed: Mar. 31, 2009

(65) Prior Publication Data

US 2010/0243113 A1 Sep. 30, 2010

(51) Int. Cl.
*C22F 1/05* (2006.01)

(52) U.S. Cl. ..... 148/698; 148/702

(58) Field of Classification Search ..... 148/698, 148/700, 702
See application file for complete search history.

(56) References Cited

U.S. PATENT DOCUMENTS 4,410,370 A * 10/1983 Baba et al. ..... 148/535
2004/0094249 A1* 5/2004 Uchida et al. ..... 148/693

OTHER PUBLICATIONS

Bull, M.J., et al., "Strain rate sensitivity: Al . . . wt% Cr", In: eds. H.J. McQueen, et al., Intl. Conf. Strength of Metals and Alloys, Pergamon Press, pp. 893-904 (1985).
Bull, M.J., et al., "Role of solute-vacancy . . . sensitivity", In: eds. S. Saimoto et al., Solute-defect interaction: theory and experiment, Pergamon Press, pp. 375-381 (1986).
Eivani, A.R., et al., "Correlation between electrical resistivity . . . alloy", Metallurgical and Materials Transaction A, 40A: 2435-2446 (2009).
Lagacé, H., et al., "The kinetics . . . recrystallization", In: eds.N. Hansen et al., 7th RISO Int. Symp., Annealing Processes . . . Grain Growth, Riso, Denmark, pp. 415-420 (1986).
Saimoto, S., et al., "Enhancement of ductility in aluminum alloys . . . processing", Material Science Forum, 475-479: 421-424 (2005).

* cited by examiner

*Primary Examiner* — Roy King
*Assistant Examiner* — Janelle Morillo
(74) *Attorney, Agent, or Firm* — Reising Ethington P.C.

(57) ABSTRACT

A cast aluminum alloy containing up to about 0.35% by weight chromium is heated to a first elevated temperature to homogenize the casting and dissolve the chromium content in an aluminum-based matrix phase. The alloy is then heated at a lower elevated temperature to cause the precipitation of a portion of the chromium as an aluminum-containing and chromium-containing intermetallic compound. A suitable amount of chromium is retained in solid solution in aluminum. Thus, the concentration of dissolved chromium in an aluminum alloy may be controlled to fall within specified ranges which result in improvements in both the strength and ductility of the alloy. Impurity amounts of iron may also be precipitated as intermetallic particles from the aluminum matrix to enhance the ductility of the aluminum-based alloy.

13 Claims, No Drawings

THERMOMECHANICAL PROCESSING OF ALUMINUM ALLOYS

TECHNICAL FIELD

This invention pertains to methods of processing chromium-containing aluminum alloys to increase their ductility and formability. More specifically this invention pertains to thermomechanical processing of such alloys to increase their formability especially at typical room temperatures.

BACKGROUND OF THE INVENTION

There are families of aluminum alloys that are prepared in the form of sheets, bars, tubes, or the like for subsequent working and shaping into articles of manufacture. For example, the Aluminum Alloys of the 2xxx, 5xxx, and 6xxx families contain silicon, iron, copper, manganese, magnesium, and zinc as alloying constituents in varying specified amounts in the respective commercial family compositions. These alloying constituents are employed to impart desired physical and corrosion resistant properties to the respective alloys. Many of these alloys also contain small amounts of chromium and titanium. Chromium and titanium are often employed to affect grain size in the wrought aluminum alloy material and thus its ductility and strength.

These aluminum alloys are widely used in metal forming operations in the manufacture of many products. Sheets, bars, and tubes can be worked at ambient factory temperatures by stamping, bending, and the like into many desired shapes. However, the wrought starting shapes do have forming limitations. For example, AA5xxx, non-heat-treatable aluminum and magnesium-containing alloys are normally used for high formability sheet forming applications but are often difficult to extrude. AA6xxx alloys are age hardenable aluminum, magnesium and silicon-containing alloys which are strong in finished form but have lower formability than the AA5xxx alloys. It is an object of this invention to improve the formability of such aluminum alloys using small amounts of chromium and thermomechanical processing in the preparation of the wrought starting material for further shaping.

SUMMARY OF THE INVENTION

This invention provides a method of distributing chromium in cast aluminum alloys so as to improve the formability of the treated aluminum alloy. In a preferred embodiment of the invention, the method may be practiced on a cast ingot of chromium-containing aluminum alloy as the ingot is converted to a prefabricated form such as by rolling to sheets, extrusion to rods, tubes, or beams, and like primary forming steps. In other embodiments of the invention the method may be practiced on a prefabricated form of the chromium-containing aluminum material which is to be further formed at an ambient temperature without heating for forming operation into a finished article of manufacture. In accordance with a preferred embodiment, a cast chromium-containing aluminum alloy ingot is subjected to thermomechanical treatment in conjunction with such prefabrication steps to control precipitation of particles and recrystallization of grains that leads to an improvement of the formability of the aluminum alloy material so that a primary workpiece body may be readily further shaped by stamping, hydroforming, tube bending, or the like, at or about room temperature or an ambient temperature.

The chromium may be added in a relatively small amount to the aluminum composition prior to formulating and casting if not otherwise specified for a selected aluminum alloy material A suitable quantity of chromium is in the range of about 0.05 to about 0.35 percent by weight of the aluminum alloy. The method is practiced to disperse small amounts of chromium atoms in solid solution in an aluminum matrix phase and the balance of the chromium as an intermetallic compound of complex composition, here referred to as $Al_6Cr$, which is typically located as small particles between larger grains of predominantly aluminum.

Often, iron is also present as a tramp element in an aluminum alloy and this invention may also be practiced to tie-up the iron as $Al_6Fe$ particles so that they do not adversely affect the formability of the aluminum material.

In an illustrative embodiment of the invention, chromium is added in an amount of, by weight, about 0.2% to an AA6063 composition. The 6063 aluminum alloy normally does not include chromium but has a typical nominal composition by weight of 0.45% magnesium, 0.4% silicon, restricted quantities of other elements, and the balance substantially aluminum. The small amount of chromium is added to a melt of the composition for casting into billets of a desired shape.

The chromium-containing aluminum alloy cast ingot is heated to a first elevated temperature below the melting point of the alloy to dissolve all or a substantial portion of the entire chromium content as a solid solution in an aluminum-rich matrix phase. In the example of AA6063 material the cast material is heated to and homogenized at about 500° C. for about four hours. The subsequent processing may be varied somewhat depending on the temperature range in which the homogenized ingot is to be shaped.

Where the cast ingot is to be subsequently shaped (for example, extruded) at temperature of about 350° C. or higher, it is preferred to freeze the chromium in solid solution by quenching the homogenized ingot. The material is thus quenched in water at room temperature until the billet (or workpiece) is cooled to ambient temperature. The rapid cooling freezes the chromium atoms in solution in the much larger volume of aluminum and the stress of the cooling introduces dislocations in the aluminum microstructure.

Following the rapid cooling, the workpiece is reheated to a second temperature, lower than the first temperature (the chromium dissolution temperature). In the example of the AA6063 material this second heating temperature may suitably be a temperature or temperature range of about 350° C. to about 400° C. The cast ingot or billet may, for example, be extruded into a prefabricated form or workpiece at this temperature range. At this second and lower temperature the chromium may not be fully soluble in the aluminum matrix. Some chromium, in the range of about 0.05 to about 0.085% by weight, remains dissolved in the aluminum matrix while any balance of the chromium content reacts with aluminum atoms to form $Al_6Cr$ particles. The dislocations appear to promote the formation of the intermetallic particles and the small particles form on the dislocations. Thus, a distribution of chromium atoms is obtained between those remaining in solid solution in aluminum and those combined with the aluminum as small particles of an intermetallic aluminum-chromium compound. This distribution of chromium atoms serves to retain the strength and other desirable properties of the aluminum alloy while rendering it more ductile and formable at ambient temperatures. The billet is extruded or otherwise hot worked in the temperature range above about 350° C. The hot worked billet may be held briefly at this temperature and then cooled below about 350° C.

While the chromium atoms are thus being redistributed in the aluminum alloy, tramp iron atoms may also be desirably precipitated as particles of $Al_6Fe$ (the particles are typically complex intermetallics but will be referred to as $Al_6Fe$ when they are precipitated at temperatures below 300° C. and contain Fe) so that they do not adversely affect the formability of the aluminum-based material. For example, the workpiece may be given a second anneal at a third, still lower temperature (e.g., about 220° C. to about 300° C. in the AA6063 alloy), so that the iron atoms, more mobile than the chromium atoms, react with the aluminum matrix to form small precipitated particles of an iron-aluminum intermetallic compound and to markedly reduce the iron content in solution in the aluminum matrix material.

In other embodiments of the invention the cast chromium-containing aluminum alloy ingot or billet may be shaped in a temperature range in which the mobility of the dissolved chromium is low and there is little likelihood of keeping a suitable amount of chromium in solid solution in the aluminum matrix. In these embodiments, the homogenized cast material at about 500° C. or so may be rapidly cooled below about 350° C. for hot rolling (e.g., 275° C.) or other hot shaping into a prefabricated form. Hot working in this temperature region likely has the beneficial side effect of allowing the precipitation of iron atoms from aluminum solid solution as dispersed fine particles of $Al_6Fe$. Following such hot working the hot worked material may be cooled to between 10° C. and 35° C. for cold rolling or other processing. But the prefab shape is ultimately reheated to above about 350° C. to permit the precipitation of some dissolved chromium atoms as particles of $Al_6Cr$, assisted by dislocations formed during rolling. Thus, some chromium, in the range of about 0.05 to about 0.085% by weight, remains dissolved in the aluminum matrix while any balance of the chromium content reacts with aluminum atoms to form $Al_6Cr$ particles.

In each embodiment of the invention, the temperature of the ingot or other workpiece is managed so as to initially place in solid solution most or all of the chromium content in an aluminum-rich matrix. Preferably, about 0.05% to about 0.085%, by weight, chromium is retained in the solid solution and a remainder of the chromium deposited as $Al_6Cr$ between the grains of the aluminum alloy material. This distribution of chromium in an aluminum alloy workpiece is found to markedly improve the elongation of the workpiece at room temperature without reducing its tensile strength.

Thus, this invention seeks to develop enhanced room temperature (for example from 10° C. to 35° C.) properties, particularly formability, in commercially available alloys such as AA5XXX and AA6XXX alloy series without loss or degradation of the beneficial properties currently offered by these alloys. The aluminum-based alloys contain, or are modified to contain, small amounts of chromium. The relatively small number of chromium atoms (compared to the aluminum content) is suitably dispersed in controlled concentration as a solid solution of chromium atoms in an aluminum-based matrix phase with any excess chromium precipitated as particles of a chromium-aluminum intermetallic compound.

Other objects and advantages of the invention will be apparent from a description of preferred embodiments which follows.

DESCRIPTION OF PREFERRED EMBODIMENTS

Although such theory is not relied upon, it is helpful to refer to the current understanding of the behavior of alloying elements in aluminum to better appreciate the significance of the sequence of steps which will be illustrated later by some specific examples.

This invention seeks to disperse small amounts of chromium in the atomic state in an aluminum matrix of an aluminum alloy so as to improve the formability of the alloy for metal working applications such as bending of tubes or stamping of flat sheet in a subsequent manufacturing operation.

However, aluminum and chromium (along with other impurity elements present in commercial grades of aluminum alloys) will react, under appropriate conditions to form particles of a metastable compound(s), represented as $Al_6Cr$, which may be beneficially employed to control the grain size during high temperature processing. The intermetallic compound $Al_6Cr$, however is not stable under all conditions encountered during processing of a chromium-containing aluminum alloy, and its beneficial effect will be lost if it decomposes into elemental chromium and aluminum.

Thus chromium confers two beneficial effects; control of grain size and improvement in formability. The series of operations and heat treatments described in detail in the examples below is intended to assure that the chromium in the alloy is present in a form which will render its desired benefits under the immediate processing conditions.

The formation or decomposition of $Al_6Cr$ requires that the chromium be mobile in aluminum so that the chromium atoms incorporated during formation or liberated during decomposition may move freely and enable the reaction. The motion of the chromium atoms is generally slow and thermally activated, being more rapid at high temperatures than at low. At sufficiently low temperatures the mobility, although finite, is so slow that the chromium effectively does not move. If the chromium atoms cannot move, then even if the particle is thermodynamically unstable it will be unable to release and disperse the chromium it contains and thus will persist despite being unstable.

Dispersal of the chromium as described above depends on both mobility and time. Thus even at elevated temperatures where mobility is higher, the distance moved by atoms in short time will be sufficiently limited that only limited dispersal will occur and particle-like behavior will continue to be observed. Only at long times when significant dispersion of the chromium atoms has occurred is the particle-like behavior not manifested.

Due to these kinetic considerations, involving both the temperature and the time at which this temperature is maintained, it may be possible to retain thermodynamically-unstable $Al_6Cr$ for sufficient time that its beneficial contributions are retained, even at high temperatures. This behavior will be used to advantage in this invention.

It is known that the mobility of different atomic species will have different temperature dependencies so that one atomic species may move relatively freely i.e. have high mobility at a specified temperature while a second atomic species at the same specified temperature may have only limited or substantially limited mobility. Further it is known that the temperature dependency of the atomic mobility may be represented by an exponential function. For this reason, apparently small differences in temperature may have a marked effect on mobility. These two characteristics; the differing behavior of differing atomic species and the large dependence of atomic mobility on temperature will be used to advantage in the present invention.

It is known that in addition to grain size, grain texture i.e. the spatial orientation of the crystals comprising the grains, plays an important role in setting the formability of aluminum alloys. In particular it is believed that the presence of iron, a tramp or residual element, inhibits the development of a particular, beneficial grain orientation known as a cube texture.

Specifically the iron must be in solution in the matrix aluminum to exert this deleterious effect and thus there is benefit to reducing its amount through enabling reaction between this iron in solution and the aluminum matrix and/or other alloying elements.

It is an objective of this invention to improve the room temperature (or ambient temperature) ductility of unheated aluminum alloys so that they may be more readily formed or fabricated into articles of manufacture. The invention may be practiced both on secondary forms of the alloys such as tubes or sheets as a process independent of their fabrication. It may most efficiently be practiced on cast ingots of the chromium-containing aluminum based material to achieve a combination of high strength and elongation at yield after thermomechanical processing of a cast ingot or billet.

Example 1

An Aluminum Extrusion Alloy 6063 with Enhanced Ductility

Aluminum alloys of a composition otherwise closely approximating that of AA6063 comprising 0.45% Mg, 0.4% Si, 0.12% Cu, 0.07% Fe, 0.09% Mn but including Cr in concentrations ranging from 0.05% to 0.35% were cast into billet form. This series of alloys will be described collectively as the 6063 alloy, and specific note will be made of the chromium content of any member of this series only where needed.

These billets were then heat treated by heating them at 500° C. for a period of at least 4 hours. At this temperature all of the alloying elements are soluble in the aluminum and their atomic mobility values are sufficiently high that, with the long time at temperature, the effect of this treatment is to ensure uniform distribution of the alloying elements throughout the billet.

At the conclusion of the homogenization treatment the billets were rapidly cooled by quenching into water at room temperature and held there until the entire volume of the billet had cooled to water temperature. This was done for two reasons.

By rapidly cooling the billet further atomic motion was suppressed and the uniform distribution of alloying elements achieved above is 'frozen in' and maintained. In addition the abrupt and non-uniform temperature reduction of the billet introduced stresses in the billet sufficient to result in a dislocation density of at least $10^8$ cm/cm$^3$. A dislocation is a specific defect, linear in character, which may occur in a crystalline lattice, for example in a substantially aluminum lattice. A dislocation, or generally groups of dislocations, will result from and participate in plastic deformation. Dislocations are stable at low temperatures but unstable at high temperatures, generally considered to be temperatures exceeding one half of the melting point of the alloy, when the melting point is expressed in Kelvin. Of significance in this invention, is that dislocations generally facilitate the formation of precipitates or small particles, for example $Al_6Cr$ particles, which will form on the dislocations due to pipe diffusion of chromium on dislocations.

Following the quench, the billet was heated to between 350° C. and 410° C. and held at this temperature for 3 hours. At this temperature Cr is not completely soluble in the substantially aluminum matrix and but instead seeks to partition itself wherein some fraction of the Cr, expected to be between 0.05 and 0.085% by weight, will remain dissolved in the substantially aluminum matrix and the remaining fraction will react with aluminum to form $Al_6Cr$. The reaction to form $Al_6Cr$ is enabled by the appreciable mobility of Cr in aluminum at temperature between 350° C. and 410° C. By holding the billet in this temperature range of 350° C. and 410° C. for 3 hours the thermodynamically-mandated partition of the chromium is enabled. The $Al_6Cr$ is precipitated as small particles located on the dislocations introduced in the prior quenching step while leaving a thermodynamically-specified quantity of chromium in solution in the substantially aluminum matrix.

The billets were then extruded into 2.75 inch diameter tubes, with an extrusion ratio of about 40:1, and under thermal processing intended to retain the beneficial attributes of the material engendered by the prior steps. Specifically the billet was heated to a temperature of 480° C. in less than 2 minutes and extrusion was conducted such that the exit temperature of the extrusion was less than 515° C. These process restrictions were imposed to prevent or reduce dissolution of the $Al_6Cr$ particles which at these temperatures are thermodynamically unstable. Further, at these temperatures, the chromium is relatively mobile. Thus the temperatures cited, chosen to facilitate the extrusion operation, would dissolve the precipitates on the dislocations if maintained for long times. To forestall this, the time at temperature is maintained as short as possible and the maximum temperature excursion restricted. This will minimize the distance the chromium atoms can traverse, impede particle dissolution and maintain at least some of the beneficial particles or particle-like features associated with the dislocations.

Following extrusion, the alloy was held for one hour between temperatures of 350° C. and 410° C. and quenched into room temperature water to refine its grain size by pinning grain boundaries through the formation or re-formation of $Al_6Cr$ precipitates. Again, this will promote the desired dissolved chromium content in the range of 0.05 to 0.085% by weight.

Finally, the extrusion is given a second low temperature anneal in the temperature range of 220° C. to 300° C. for one hour. At this temperature chromium is essentially immobile. Thus this treatment will not undo the beneficial effects of the prior heat treatment in introducing the desired dissolved chromium content. However, at this temperature iron is mobile and this heat treatment will promote the reaction of iron dissolved in the substantially-aluminum matrix to form an iron-aluminum compound, believed to also be a metastable compound $Al_6Fe$ in the form of fine precipitates. This treatment accomplishes two objectives: first it reduces the matrix iron content to below 0.0002% by weight which will accentuate the beneficial effects of chromium on formability and; second, the $Al_6Fe$ precipitates may participate in grain refinement during subsequent deformation processing.

The utility and effectiveness of the approaches detailed above has been validated for the extruded near-AA6063 alloy described above. Data extracted from a tensile test conducted on chromium-containing alloys processed as above and similarly-processed chromium-free alloys are reproduced in Table 1 below. It will be appreciated by those skilled in the art that the Tensile Strength of an alloy is a measure of its strength and that the Total Elongation is a measure of its ductility or formability. Thus the alloy with chromium additions and treated following the procedure described herein shows both improved strength and improved ductility over the chromium-free alloy.

TABLE 1

| | Tensile Strength (MPa) | Total Elongation (%) |
|---|---|---|
| AA6063 alloy—chromium free | 171 | 23.7 |
| AA6063 alloy—chromium-containing | 204 | 28.0 |

This is an unexpected result. For most alloys, ductility and strength are inversely correlated so that improved ductility is achieved at the expense of strength and improved strength at the expense of ductility.

The utility and effectiveness of the procedures detailed above has been further validated for the extruded near-AA6063 alloy described above by bending tubes fabricated from this alloy, both with and without chromium additions. These two variants demonstrated dramatically different behaviors. In the chromium containing alloy, a bend with a bend radius equal to the tube diameter was successfully fabricated: for the chromium-free alloy reducing the bend radius to less than twice the tube diameter resulting in cracking and splitting of the tube.

Example 2

An Aluminum Sheet Alloy AA5754 with Enhanced Ductility

Alloy AA5754, by specification, has a composition, by weight, of 2.60-3.60% magnesium, up to 0.5% manganese, up to 0.4% silicon, up to 0.4% iron, up to 0.3% chromium, up to 0.2% zinc, up to 0.15% titanium, balance aluminum, with the further stipulation that the sum of the chromium and manganese contents not exceed 0.6%.

An AA5754 alloy with a chromium content of at least between 0.05 and 0.35 weight percent and more preferably between 0.2 and 0.35 weight percent was produced as direct chill cast ingot. The as-cast ingot was then held at a temperature greater than 500° C. for four hours. This accomplished both homogenization of the ingot so that a uniform distribution of alloying elements was developed throughout the ingot and also ensured that the iron, a tramp or residual element, is fully dissolved in the aluminum matrix.

The homogenized ingot was then hot rolled from its original approximately 30 mm thickness to 3.5 mm thickness and the exit temperature of the rolling process was controlled not to exceed 275° C. The 3.5 mm hot band was subjected to a controlled slow cooling process by wrapping the hot band in a thermal insulation layer. This was to promote the nucleation of grains of the desirable cube texture without appreciable growth. A further beneficial outcome of this procedure is that it enables the precipitation, as $Al_6Fe$, of much of the iron dissolved in the matrix by the earlier heat treatment. In an alternative embodiment, this step may be accomplished by holding the hot band at 260° C. for two days.

Subsequent to either of the above embodiments the hot band should be cooled to a temperature of approximately room temperature that is a temperature of between about 10° C. and 35° C. The hot band should then be further reduced in thickness to about 1 mm sheet by cold rolling, that is, rolling without preheating the band, thereby introducing dislocations and leaving a residual dislocation structure after rolling.

The cold reduced strip is then heated to 385° C. and held at that temperature for 30 minutes to precipitate $Al_6Cr$ on the dislocation structure so that as recrystallization proceeds the $Al_6Cr$ will pin the grain boundaries and hold the grain size to an acceptably low value, preferably no greater than 10 μm. This treatment is also intended to retain in solution a quantity of about 0.07% by weight of chromium in the aluminum alloy to develop the beneficial effects on formability described earlier Finally, the strip is maintained at a temperature of 300° C. for one hour to remove additional iron from the substantially aluminum matrix while retaining the desired beneficial quantity of chromium in the substantially aluminum matrix. As with the 6063 alloy, this is achieved as a result of the essential lack of mobility of chromium at this temperature, coupled with the relatively high iron mobility. The control of both the dissolved chromium and iron achieved by this process is anticipated to confer advantages to the AA5754 comparable to those observed in the 6063 alloy.

This invention involves the creation of a preferred quantity of chromium dissolved in a substantially aluminum matrix in an aluminum alloy. The prefabrication process is manipulated to accomplish the dispersion of elemental chromium in the matrix and differs from process to (e.g., rolling vs. extrusion) to accomplish like microstructural attributes.

Current aluminum alloy compositions as specified, for example, by the Aluminum Association may or may not include sufficient chromium for the practice of this invention. It is clear that this invention may also be applied directly to those commercially-available alloys which, by specification comprise adequate quantities of chromium to practice the invention but which are not subjected to the necessary thermomechanical treatments to partition the chromium into solution in aluminum matrix and $Al_6Cr$ particles as described above. It is however also the intent of this invention that it be broadly applicable. Thus it is anticipated that it will be practiced with aluminum alloys of custom chemistry where the alloy composition is otherwise representative of standard alloys but with enhanced chromium content.

This invention further involves enhancing the formability of any of these commercially available or modified commercially-available alloys without degrading any of the other properties. This invention has been described in terms of two preferred embodiments. However the microstructural and chemical changes associated with the individual processing steps have been described in sufficient detail to enable one skilled in the art to apply this invention to alternate alloys, alloy chemistries, and prefabrication processing paths to achieve similar beneficial effects on formability.

Accordingly the scope of this invention is limited only by the following claims.

The invention claimed is:

1. A method for increasing the room temperature formability of an aluminum alloy article comprising aluminum as a major constituent and chromium as an alloying element in a total amount in the range of about 0.05% to about 0.35% by weight, and further comprising iron as an impurity; the method comprising:

heating the alloy to a first temperature at which the chromium and the iron are substantially dissolved in a matrix of aluminum;

quenching the aluminum alloy to below about 35° C. in a first quench to retain the chromium and the iron in solution in the aluminum matrix;

heating the aluminum alloy to a second temperature, lower than the first temperature to precipitate a portion of the chromium content from the matrix of aluminum as particles of a chromium-containing and aluminum-containing intermetallic compound, the remainder of the chromium content being retained in solid solution in the aluminum matrix, and the iron continuing to be maintained substantially in solid solution in the matrix of aluminum;

quenching the aluminum alloy to below about 35° C. in a second quench to retain the chromium and the iron in solution in the aluminum matrix;

heating the aluminum alloy to a third temperature, lower than the second temperature, to cause a substantial portion of the iron content to be precipitated from the matrix of aluminum as particles of an iron-containing and aluminum-containing intermetallic compound, the remainder of the chromium continuing to be maintained substantially in solid solution in the matrix of aluminum; and cooling the aluminum alloy to a temperature less than about 35° C.

2. A method for increasing the room temperature formability of a shaped, aluminum alloy casting fabricated from a cast alloy comprising aluminum as a major constituent, chromium as an alloying element in a total amount in the range of about 0.05% to about 0.35% by weight and iron as an impurity, where the casting is to be shaped at a temperature of greater than 410° C.; the method comprising:

heating the aluminum alloy casting at a first temperature of about 500° C. or higher at which the chromium and iron are substantially dissolved in a matrix of aluminum;

quenching the aluminum alloy casting to below about 35° C. to retain the chromium and iron in solution in the aluminum matrix; then reheating the aluminum alloy casting to a temperature of between 350° C.-410° C. for a first predetermined time to precipitate a portion of the chromium from the aluminum matrix as an intermetallic compound of aluminum and chromium while retaining the iron in solution;

rapidly raising the temperature of the aluminum alloy casting above 410° C. to the shaping temperature and immediately shaping the aluminum alloy casting;

quenching the shaped casting to below about 35° C.;

reheating the shaped casting to a temperature of between 350° C.-410° C. for a second predetermined time and cooling, the shaped casting being characterized by a chromium and an iron content retained in solid solution in the aluminum matrix and precipitated particles of a chromium-containing and aluminum-containing intermetallic compound; and heating the shaped casting to a temperature of between 270° C. and 320° C. for between 1 and 3 hours to cause a substantial portion of the iron content to be precipitated from the matrix of aluminum as particles of an iron-containing and aluminum-containing intermetallic compound, the retained chromium content continuing to be maintained substantially in solid solution in the matrix of aluminum.

3. The method of claim 2 wherein the chromium remaining dissolved in the substantially aluminum matrix is in the range 0.05 to 0.085 percent by weight.

4. The method of claim 2 wherein the first predetermined time is in the range of 1 hour to 4 hours and the second predetermined time is in the range of 30 minutes to 120 minutes.

5. A method for increasing the room temperature formability of a shaped, aluminum alloy casting fabricated from a cast alloy comprising aluminum as a major constituent, chromium as an alloying element in a total amount in the range of about 0.05% to about 0.35% by weight and iron as an impurity, where the casting is to be shaped at a temperature between 350° C. and 410° C.; the method comprising:

heating the aluminum alloy casting at a first temperature of about 500° C. or higher at which the chromium and iron are substantially dissolved in a matrix of aluminum;

quenching the aluminum alloy casting to below about 35° C. to retain the chromium in solution in the aluminum matrix; then reheating the aluminum alloy casting to the shaping temperature for a first predetermined time;

shaping the aluminum alloy casting;

heating the shaped casting at a temperature of between 350° C.-410° C. for a second predetermined time and cooling to below about 35° C., the shaped casting being characterized by a chromium and an iron content retained in solid solution in the aluminum matrix and precipitated particles of a chromium-containing and aluminum-containing intermetallic compound; and heating the shaped casting to a temperature of between 270° C. and 320° C. for between 1 and 3 hours to cause a substantial portion of the iron content to be precipitated from the matrix of aluminum as particles of an iron-containing and aluminum-containing intermetallic compound, the retained chromium content continuing to be maintained substantially in solid solution in the matrix of aluminum.

6. The method of claim 5 wherein the quantity of chromium dissolved in the aluminum matrix is in the range of 0.05 to 0.085 percent by weight.

7. The method of claim 5 wherein the first predetermined time is in the range of 1 hour to 4 hours and the second predetermined time is in the range of 30 minutes to 120 minutes.

8. A method for increasing the room temperature formability of a shaped, aluminum alloy casting fabricated from a cast alloy comprising aluminum as a major constituent, chromium as an alloying element in a total amount in the range of about 0.05% to about 0.35% by weight and iron as an impurity, where the casting is to be shaped at a temperature of less than 350° C.; the method comprising:

heating the aluminum alloy casting at a first temperature of about 500° C. or higher at which the chromium and iron are substantially dissolved in a matrix of aluminum;

cooling the aluminum alloy casting to the shaping temperature;

shaping the casting;

heating the shaped casting at a temperature of between 350° C.-410° C. for a predetermined time and cooling to below about 35° C., the shaped casting being characterized by a chromium content and an iron content retained in solid solution in the aluminum matrix and precipitated particles of a chromium-containing and aluminum-containing intermetallic compound; and heating the shaped casting to a temperature of between 270° C. and 320° C. for between 1 and 3 hours to cause a substantial portion of the iron content to be precipitated from the matrix of aluminum as particles of an iron-containing and aluminum-containing intermetallic compound, the retained chromium content continuing to be maintained substantially in solid solution in the matrix of aluminum.

9. The method of claim 8 wherein the chromium remaining dissolved in the substantially aluminum matrix is in the range 0.05 to 0.085 percent by weight.

10. The method of claim 8 wherein the predetermined time is in the range of 1 hour to 4 hours.

11. A method for increasing the room temperature formability of a shaped, aluminum alloy article comprising aluminum as a major constituent, and chromium as an alloying element in a total amount in the range of about 0.05% to about 0.35% by weight and iron as an impurity; the method comprising:

heating the article at a first temperature of about 500° C. or higher at which the chromium and the iron are substantially dissolved in a matrix of aluminum;

quenching the article to below about 35° C. to retain the chromium and iron in solution in the aluminum matrix; then reheating the aluminum alloy casting to a temperature of between 350° C.-410° C. for a predetermined time; and cooling the article to a temperature less than about 35° C.; the article being characterized by a chromium content and an iron content retained in solid solution in the aluminum matrix and precipitated particles of a chromium-containing and aluminum-containing intermetallic compound; and heating the shaped casting to a temperature of between 270° C. and 320° C. for between 1 and 3 hours to cause a substantial portion of the iron content to be precipitated from the matrix of aluminum as particles of an iron-containing and aluminum-containing intermetallic compound, the retained chromium content continuing to be maintained substantially in solid solution in the matrix of aluminum.

12. The method of claim 11 wherein the chromium remaining dissolved in the substantially aluminum matrix is in the range 0.05 to 0.085 percent by weight.

13. The method of claim 11 wherein the predetermined time is in the range of 1 hour to 4 hours.

* * * * *